US011149989B2

(12) United States Patent
Wang et al.

(10) Patent No.: US 11,149,989 B2
(45) Date of Patent: Oct. 19, 2021

(54) HIGH EFFICIENCY EJECTOR CYCLE

(71) Applicant: Carrier Corporation, Palm Beach Gardens, FL (US)

(72) Inventors: Jinliang Wang, Ellington, CT (US); Parmesh Verma, South Windsor, CT (US)

(73) Assignee: Carrier Corporation, Palm Beach Gardens, FL (US)

( * ) Notice: Subject to any disclaimer, the term of this patent is extended or adjusted under 35 U.S.C. 154(b) by 219 days.

(21) Appl. No.: 16/565,995

(22) Filed: Sep. 10, 2019

(65) Prior Publication Data

US 2020/0003456 A1 Jan. 2, 2020

Related U.S. Application Data

(63) Continuation of application No. 13/703,023, filed as application No. PCT/US2011/044614 on Jul. 20, 2011, now abandoned.

(Continued)

(51) Int. Cl.

| | |
|---|---|
| ***F25B 1/06*** | (2006.01) |
| ***F25B 41/00*** | (2021.01) |
| ***F25B 43/00*** | (2006.01) |

(52) U.S. Cl.

CPC ..... *F25B 1/06* (2013.01); *F25B 41/00* (2013.01); *F25B 43/006* (2013.01);

(Continued)

(58) Field of Classification Search

CPC ..... F25B 1/06; F25B 41/00; F25B 43/006; F25B 2341/0011; F25B 2341/0015; F25B 2341/0013; F25B 2309/061

(Continued)

(56) References Cited

U.S. PATENT DOCUMENTS 1,870,265 A * 8/1932 Seligmann ..... F25B 1/08 62/109

2,286,605 A 6/1942 Crawford (Continued)

FOREIGN PATENT DOCUMENTS

CN 1869551 A 11/2006
CN 101403536 A 4/2009

(Continued)

OTHER PUBLICATIONS

International Search Report and Written Opinion dated Jan. 9, 2012 for PCT/US2011/044614.

(Continued)

*Primary Examiner* — Eric S Ruppert
*Assistant Examiner* — Kirstin U Oswald
(74) *Attorney, Agent, or Firm* — Bachman & LaPointe, P.C.

(57) ABSTRACT

A system has a compressor, a heat rejection heat exchanger, first and second ejectors, first and second heat absorption heat exchangers, and first and second separators. The heat rejection heat exchanger is coupled to the compressor to receive refrigerant compressed by the compressor. The first ejector has a primary inlet coupled to the heat rejection exchanger to receive refrigerant, a secondary inlet, and an outlet. The first separator has an inlet coupled to the outlet of the first ejector to receive refrigerant from the first ejector. The first separator has a gas outlet coupled to the compressor to return refrigerant to the compressor. The first separator has a liquid outlet coupled to the secondary inlet of the ejector to deliver refrigerant to the first ejector. The first heat absorption heat exchanger is coupled to the liquid outlet of the first separator to receive refrigerant and to the secondary inlet of the first ejector to deliver refrigerant to the first ejector. The second ejector has a primary inlet coupled to the (Continued)

liquid outlet of the first separator to receive refrigerant, a secondary inlet, and an outlet. The second separator has an inlet coupled to an outlet of the second ejector to receive refrigerant from the second ejector, a gas outlet coupled to the compressor to return refrigerant to the compressor, and a liquid outlet. The second heat absorption heat exchanger is coupled to the liquid outlet of the second separator to receive refrigerant and to the secondary inlet of the second ejector to deliver refrigerant to the second ejector.

20 Claims, 4 Drawing Sheets

Related U.S. Application Data

(60) Provisional application No. 61/367,100, filed on Jul. 23, 2010.

(52) U.S. Cl.
CPC . *F25B 2309/061* (2013.01); *F25B 2341/0011* (2013.01); *F25B 2341/0013* (2013.01); *F25B 2341/0015* (2013.01)

(58) Field of Classification Search
USPC ..... 62/500
See application file for complete search history.

(56) References Cited

U.S. PATENT DOCUMENTS

| | | | | | |
|---|---|---|---|---|---|
| 2,931,190 | A * | 4/1960 | Dubitzky | F25B 1/08 | 62/114 |
| 3,300,995 | A * | 1/1967 | McGrath | F25B 13/00 | 62/116 |
| 3,778,969 | A | 12/1973 | Sudduth | | |
| 4,342,200 | A | 8/1982 | Lowi, Jr. | | |
| 4,765,148 | A | 8/1988 | Ohashi | | |
| 5,343,711 | A * | 9/1994 | Kornhauser | F25B 1/06 | 417/198 |
| 7,178,359 | B2 * | 2/2007 | Oshitani | F25B 41/00 | 62/500 |
| 7,401,475 | B2 | 7/2008 | Hugenroth et al. | | |
| 2002/0124592 | A1 | 9/2002 | Takeuchi et al. | | |
| 2003/0131611 | A1 | 7/2003 | Oshitani et al. | | |
| 2004/0123624 | A1 * | 7/2004 | Ohta | F25B 5/02 | 62/498 |
| 2005/0178150 | A1 * | 8/2005 | Oshitani | F25B 41/00 | 62/500 |
| 2005/0268644 | A1 * | 12/2005 | Oshitani | F25B 5/00 | 62/500 |
| 2007/0028630 | A1 | 2/2007 | Yamada et al. | | |
| 2008/0196446 | A1 | 8/2008 | Nakamura et al. | | |
| 2009/0013704 | A1 | 1/2009 | Oshitani et al. | | |
| 2009/0090129 | A1 | 4/2009 | Ikegami et al. | | |
| 2009/0229304 | A1 * | 9/2009 | Ogata | F25B 41/00 | 62/500 |
| 2010/0095704 | A1 | 4/2010 | Ignatiev et al. | | |
| 2010/0223938 | A1 | 9/2010 | Bush et al. | | |
| 2010/0313582 | A1 | 12/2010 | Oh et al. | | |
| 2011/0259039 | A1 | 10/2011 | Ma et al. | | |

FOREIGN PATENT DOCUMENTS

| | | | | |
|---|---|---|---|---|
| CN | 102128508 | A | 7/2011 | |
| JP | 2001221517 | A * | 8/2001 | F25B 9/008 |
| JP | 2001221517 | A | 8/2001 | |
| JP | 2007003171 | A | 1/2007 | |

OTHER PUBLICATIONS

Chinese Office Action dated Sep. 2, 2014 for CN Patent Application No. 201180036062.2.
Chinese Office Action dated Apr. 24, 2015 for CN Patent Application No. 201180036062.2.
European Office Action dated Dec. 10, 2013 for EP Patent Application No. 11738122.8.
U.S. Office Action dated Oct. 29, 2014 for U.S. Appl. No. 13/703,023.
U.S. Office Action dated May 19, 2015 for U.S. Appl. No. 13/703,023.
U.S. Office Action dated Feb. 8, 2016 for U.S. Appl. No. 13/703,023.
U.S. Office Action dated May 11, 2016 for U.S. Appl. No. 13/703,023.

* cited by examiner

HIGH EFFICIENCY EJECTOR CYCLE

CROSS-REFERENCE TO RELATED APPLICATION

This is a continuation application of U.S. patent application Ser. No. 13/703,023, filed Dec. 9, 2012 and entitled "High Efficiency Ejector Cycle", which is a 371 US national stage application of PCT/US2011/044614, filed Jul. 20, 2011, which benefit is claimed of U.S. patent application Ser. No. 61/367,100, filed Jul. 23, 2010, and entitled "High Efficiency Ejector Cycle", the disclosure of which is incorporated by reference herein in its entirety as if set forth at length.

BACKGROUND

The present disclosure relates to refrigeration. More particularly, it relates to ejector refrigeration systems.

Earlier proposals for ejector refrigeration systems are found in U.S. Pat. Nos. 1,836,318, and 3,277,660. FIG. 1 shows one basic example of an ejector refrigeration system 20. The system includes a compressor 22 having an inlet (suction port) 24 and an outlet (discharge port) 26. The compressor and other system components are positioned along a refrigerant circuit or flowpath 27 and connected via various conduits (lines). A discharge line 28 extends from the outlet 26 to the inlet 32 of a heat exchanger (a heat rejection heat exchanger in a normal mode of system operation (e.g., a condenser or gas cooler)) 30. A line 36 extends from the outlet 34 of the heat rejection heat exchanger 30 to a primary inlet (liquid or supercritical or two-phase inlet) 40 of an ejector 38. The ejector 38 also has a secondary inlet (saturated or superheated vapor or two-phase inlet) 42 and an outlet 44. A line 46 extends from the ejector outlet 44 to an inlet 50 of a separator 48. The separator has a liquid outlet 52 and a gas outlet 54. A suction line 56 extends from the gas outlet 54 to the compressor suction port 24. The lines 28, 36, 46, 56, and components therebetween define a primary loop 60 of the refrigerant circuit 27. A secondary loop 62 of the refrigerant circuit 27 includes a heat exchanger 64 (in a normal operational mode being a heat absorption heat exchanger (e.g., evaporator)). The evaporator 64 includes an inlet 66 and an outlet 68 along the secondary loop 62 and expansion device 70 is positioned in a line 72 which extends between the separator liquid outlet 52 and the evaporator inlet 66. An ejector secondary inlet line 74 extends from the evaporator outlet 68 to the ejector secondary inlet 42.

In the normal mode of operation, gaseous refrigerant is drawn by the compressor 22 through the suction line 56 and inlet 24 and compressed and discharged from the discharge port 26 into the discharge line 28. In the heat rejection heat exchanger, the refrigerant loses/rejects heat to a heat transfer fluid (e.g., fan-forced air or water or other fluid). Cooled refrigerant exits the heat rejection heat exchanger via the outlet 34 and enters the ejector primary inlet 40 via the line 36.

The exemplary ejector 38 (FIG. 2) is formed as the combination of a motive (primary) nozzle 100 nested within an outer member 102. The primary inlet 40 is the inlet to the motive nozzle 100. The outlet 44 is the outlet of the outer member 102. The primary refrigerant flow 103 enters the inlet 40 and then passes into a convergent section 104 of the motive nozzle 100. It then passes through a throat section 106 and an expansion (divergent) section 108 through an outlet 110 of the motive nozzle 100. The motive nozzle 100 accelerates the flow 103 and decreases the pressure of the flow. The secondary inlet 42 forms an inlet of the outer member 102. The pressure reduction caused to the primary flow by the motive nozzle helps draw the secondary flow 112 into the outer member. The outer member includes a mixer having a convergent section 114 and an elongate throat or mixing section 116. The outer member also has a divergent section or diffuser 118 downstream of the elongate throat or mixing section 116. The motive nozzle outlet 110 is positioned within the convergent section 114. As the flow 103 exits the outlet 110, it begins to mix with the flow 112 with further mixing occurring through the mixing section 116 which provides a mixing zone. In operation, the primary flow 103 may typically be supercritical upon entering the ejector and subcritical upon exiting the motive nozzle. The secondary flow 112 is gaseous (or a mixture of gas with a smaller amount of liquid) upon entering the secondary inlet port 42. The resulting combined flow 120 is a liquid/vapor mixture and decelerates and recovers pressure in the diffuser 118 while remaining a mixture. Upon entering the separator, the flow 120 is separated back into the flows 103 and 112. The flow 103 passes as a gas through the compressor suction line as discussed above. The flow 112 passes as a liquid to the expansion valve 70. The flow 112 may be expanded by the valve 70 (e.g., to a low quality (two-phase with small amount of vapor)) and passed to the evaporator 64. Within the evaporator 64, the refrigerant absorbs heat from a heat transfer fluid (e.g., from a fan-forced air flow or water or other liquid) and is discharged from the outlet 68 to the line 74 as the aforementioned gas.

Use of an ejector serves to recover pressure/work. Work recovered from the expansion process is used to compress the gaseous refrigerant prior to entering the compressor. Accordingly, the pressure ratio of the compressor (and thus the power consumption) may be reduced for a given desired evaporator pressure. The quality of refrigerant entering the evaporator may also be reduced. Thus, the refrigeration effect per unit mass flow may be increased (relative to the non-ejector system). The distribution of fluid entering the evaporator is improved (thereby improving evaporator performance). Because the evaporator does not directly feed the compressor, the evaporator is not required to produce superheated refrigerant outflow. The use of an ejector cycle may thus allow reduction or elimination of the superheated zone of the evaporator. This may allow the evaporator to operate in a two-phase state which provides a higher heat transfer performance (e.g., facilitating reduction in the evaporator size for a given capability).

The exemplary ejector may be a fixed geometry ejector or may be a controllable ejector. FIG. 2 shows controllability provided by a needle valve 130 having a needle 132 and an actuator 134. The actuator 134 shifts a tip portion 136 of the needle into and out of the throat section 106 of the motive nozzle 100 to modulate flow through the motive nozzle and, in turn, the ejector overall. Exemplary actuators 134 are electric (e.g., solenoid or the like). The actuator 134 may be coupled to and controlled by a controller 140 which may receive user inputs from an input device 142 (e.g., switches, keyboard, or the like) and sensors (not shown). The controller 140 may be coupled to the actuator and other controllable system components (e.g., valves, the compressor motor, and the like) via control lines 144 (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices and controllable system components.

Various modifications of such ejector systems have been proposed. One example in US20070028630 involves placing a second evaporator along the line 46. US20040123624 discloses a system having two ejector/evaporator pairs. Another two-evaporator, single-ejector system is shown in US20080196446. Another method proposed for controlling the ejector is by using hot-gas bypass. In this method a small amount of vapor is bypassed around the gas cooler and injected just upstream of the motive nozzle, or inside the convergent part of the motive nozzle. The bubbles thus introduced into the motive flow decrease the effective throat area and reduce the primary flow. To reduce the flow further more bypass flow is introduced

SUMMARY

One aspect of the disclosure involves a system having a compressor, a heat rejection heat exchanger, first and second ejectors, first and second heat absorption heat exchangers, and first and second separators. The heat rejection heat exchanger is coupled to the compressor to receive refrigerant compressed by the compressor. The first ejector has a primary inlet coupled to the heat rejection exchanger to receive refrigerant, a secondary inlet, and an outlet. The first separator has an inlet coupled to the outlet of the first ejector to receive refrigerant from the first ejector. The first separator has a gas outlet coupled to the compressor to return refrigerant to the compressor. The first separator has a liquid outlet coupled to the secondary inlet of the ejector to deliver refrigerant to the first ejector. The first heat absorption heat exchanger is coupled to the liquid outlet of the first separator to receive refrigerant and to the secondary inlet of the first ejector to deliver refrigerant to the first ejector. The second ejector has a primary inlet coupled to the liquid outlet of the first separator to receive refrigerant, a secondary inlet, and an outlet. The second separator has an inlet coupled to an outlet of the second ejector to receive refrigerant from the second ejector, a gas outlet coupled to the compressor to return refrigerant to the compressor, and a liquid outlet. The second heat absorption heat exchanger is coupled to the liquid outlet of the second separator to receive refrigerant and to the secondary inlet of the second ejector to deliver refrigerant to the second ejector.

In various implementations, one or both separators may be gravity separators. The system may have no other separator (i.e., the two separators are the only separators). The system may have no other ejector. The second heat absorption heat exchanger may be positioned between the outlet of the second ejector and the compressor. The refrigerant may comprise at least 50% carbon dioxide, by weight. The system may further include a mechanical subcooler positioned between: the heat rejection heat exchanger; and the inlet of the first ejector and the inlet of the second ejector. The system may further include a suction line heat exchanger having a heat rejection heat exchanger and a heat rejection leg and a heat absorption leg. The heat rejection leg may be positioned between: the heat rejection heat exchanger; and the inlet of the first ejector and the inlet of the second ejector. The heat absorption leg may be positioned between the second heat absorption heat exchanger and the compressor suction. The first and second heat absorption heat exchangers may respectively be in first and second refrigerated spaces.

Other aspects of the disclosure involve methods for operating the system.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
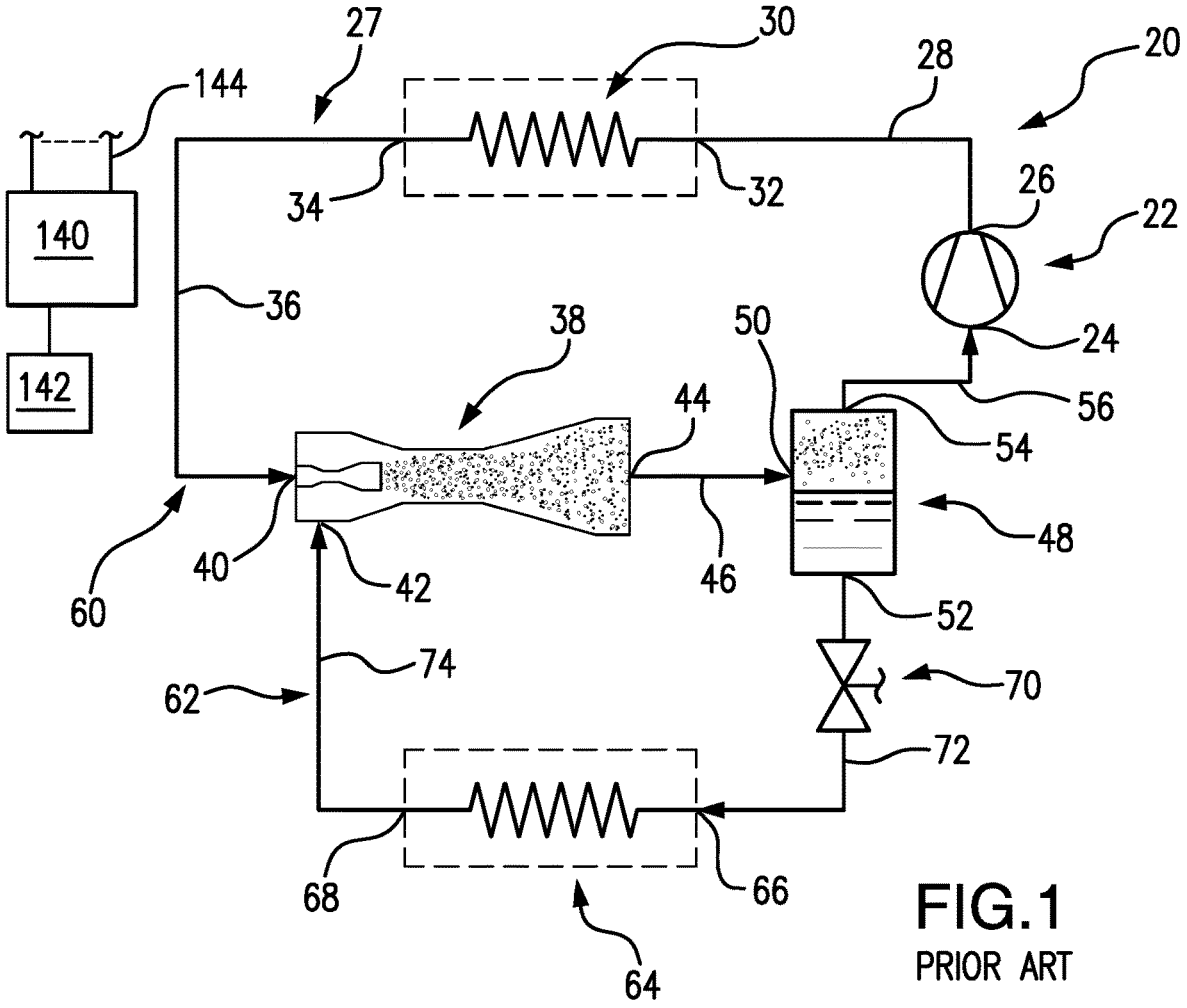
FIG.1 PRIOR ART
FIG. 1 is a schematic view of a prior art ejector refrigeration system.
Figure 2:
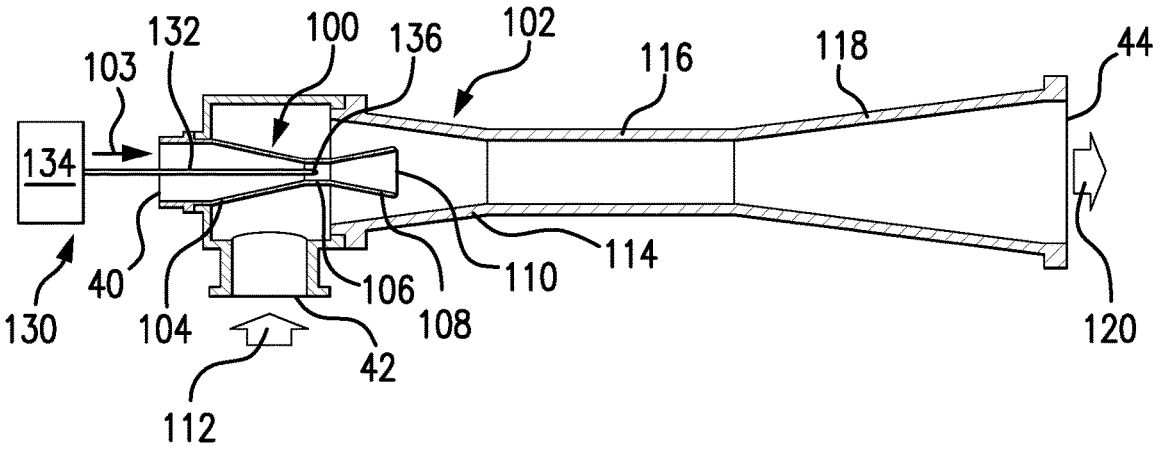
FIG. 2 PRIOR ART
FIG. 2 is an axial sectional view of an ejector.
Figure 3:
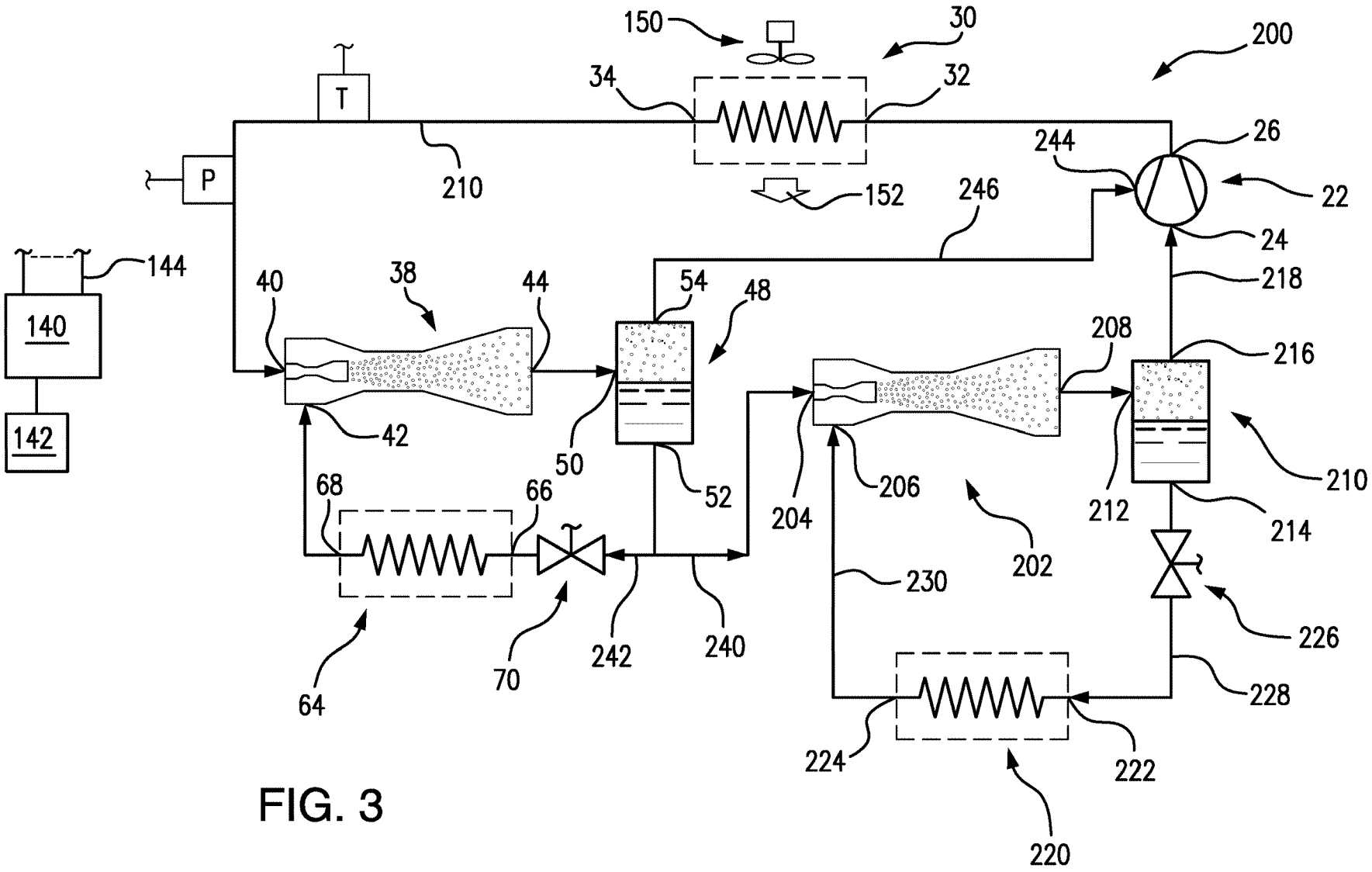
FIG. 3 is a schematic view of a first refrigeration system.

FIG. 3 shows an ejector cycle vapor compression (refrigeration) system 200. The system 200 may be made as a modification of the system 20 or of another system or as an original manufacture/configuration. In the exemplary embodiment, like components which may be preserved from the system 20 are shown with like reference numerals. Operation may be similar to that of the system 20 except as discussed below with the controller controlling operation responsive to inputs from various temperature sensors and pressure sensors.

The ejector 38 is a first ejector and the system further includes a second ejector 202 having a primary inlet 204, a secondary inlet 206, and an outlet 208 and which may be configured similarly to the first ejector 38.

Similarly, the separator 48 is a first separator. The system further includes a second separator 210 having an inlet 212, a liquid outlet 214, and a gas outlet 216. In the exemplary system, the gas outlet 216 is connected via a line 218 to the suction port 24.

Similarly, the evaporator 64 is a first evaporator. The system further includes a second evaporator 220 having an inlet 222 and an outlet 224. The second evaporator inlet 222 receives refrigerant from the second separator outlet 214 via a second expansion valve 226 in a line 228. The refrigerant flow from the outlet 224 of the second evaporator passes to the second ejector secondary inlet 206 via a line 230.

The second ejector primary inlet 204 receives liquid refrigerant from the first separator. This may be delivered by a branch conduit 240 branching off the line/flowpath from the first separator to the liquid outlet 52 to the first evaporator inlet 66 upstream of the valve 70.

In the exemplary embodiment, the compressor is an economized compressor having an intermediate port (e.g., economizer port) 244 at an intermediate stage in compression between the suction port 24 and discharge port 26. The first separator gas outlet 54 is connected to the intermediate port 244 by a line 246.

Figure 4:
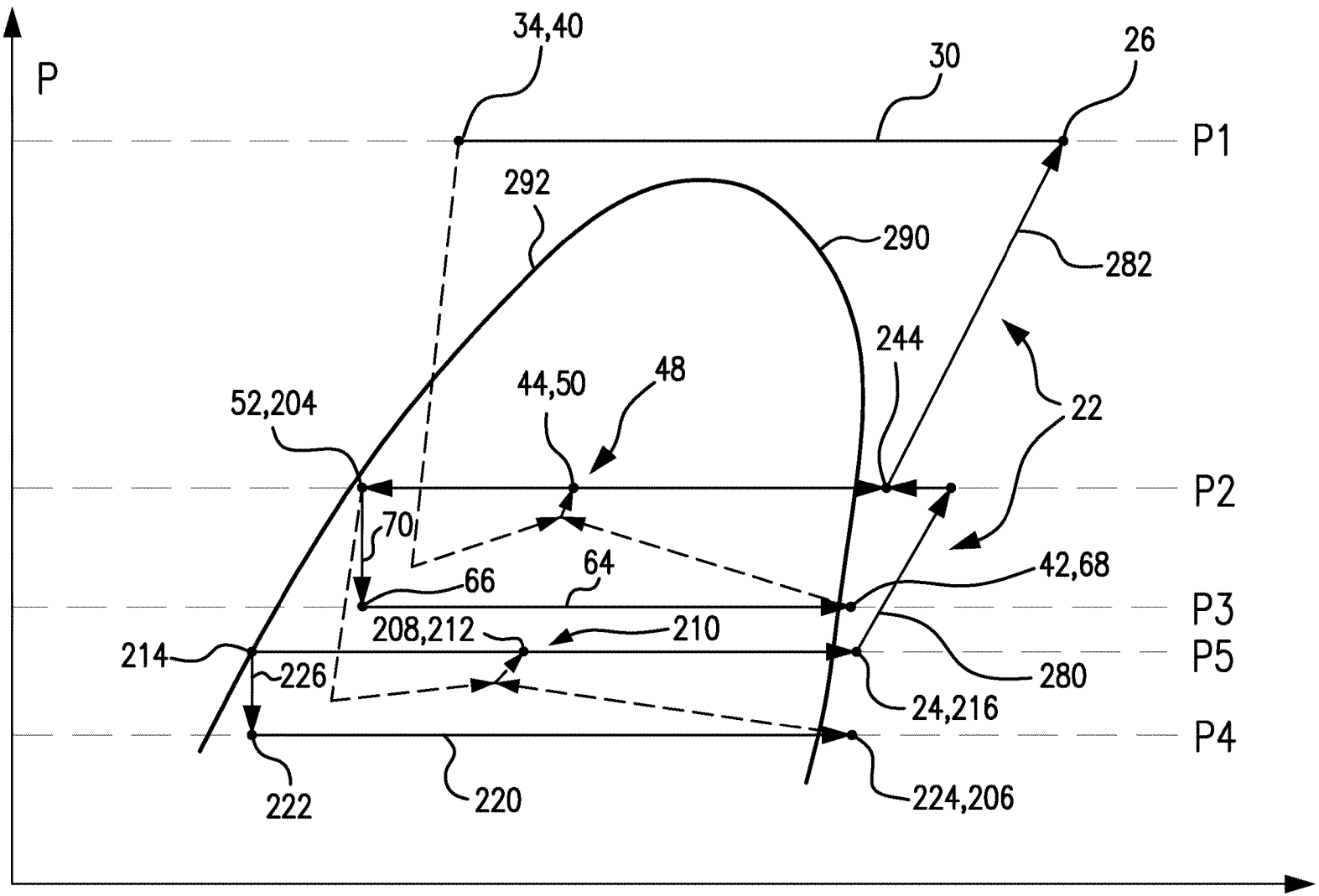
FIG. 4 is a pressure-enthalpy (Mollier) diagram of the system of FIG. 3.

FIG. 4 shows the two compression stages as 280 (from the suction port 24 to the economizer port 224) and 282 (from the economizer port 224 to the discharge port 26). The compressor discharge pressure is shown as P1 whereas the suction pressure is shown as P5. The exemplary suction condition is to the vapor side of the saturated vapor line 290.

The first evaporator 64 is shown operating in a pressure P3 between the pressures P2 and P5. The second evaporator 220 operates at a pressure P4 below P5. P2 and P5 represent the respective outlet pressures of the first separator 48 and second separator 210. The exemplary expansion devices 70 and 226 have inlet conditions at P2 and P5, respectively, at or near the saturated liquid line 292 (e.g., slightly within the vapor dome).

In operation, the first ejector may be used primarily to control the high side pressure P1 and secondarily the capacity of the first evaporator. The second ejector may be used to control the capacity of the second evaporator. For example, to increase the capacity of the first evaporator, the first ejector is opened (e.g., its needle extracted to lower P1); to decrease capacity, it is closed (e.g., its needle is inserted to increase P1). To increase the capacity of the second evaporator, the second ejector is similarly opened (to decrease, closed). P1 may be controlled to optimize system efficiency. For a transcritical cycle such as using carbon dioxide, raising P1 decreases the enthalpy out of the gas cooler 30 and increases the cooling available for a given compressor mass flow rate. However, P1 also increases compressor power. There is an optimum value of P1 that maximizes system efficiency at a given operating condition (e.g., ambient temperature, compressor speed, and evaporation temperatures). To raise P1 to the target value, the first ejector is closed (to lower P1, opened).

A temperature sensor T and pressure transducer P at the outlet of the gas cooler may (also or alternatively) provide inputs used to control ejector opening. For example, such a temperature sensor measures gas cooler exit temperature which is an indication of the ambient temperature. Typically, the measured temperature will be 1-7° F. (0.6-4.0° C.) higher than the ambient temperature. Similarly, the gas cooler exit pressure is strongly correlated to the compressor discharge pressure (e.g., 0.5-5% lower than the compressor discharge pressure). Thus, the two sensors provide proxies for ambient temperature and compressor discharge pressure, respectively. For a given measured temperature, if the measured pressure is higher than the target value, the control system may cause the first ejector to be further opened (if lower than the target value, closed).

Controllable expansion devices 70 and 226 may be used to control the state of the refrigerant leaving the evaporators 64 and 220. For each evaporator, a target value of superheat may be maintained. Superheat may be determined by a pressure transducer and temperature sensor downstream of the associated evaporator. Alternatively, pressure can be estimated from a temperature sensor at the saturated region of the evaporator. To increase superheat, the associated expansion device is closed (to decrease, opened). Too high a superheat value results in a high temperature difference required between the refrigerant and air temperature and thus a lower evaporation pressure. If the expansion device is to open, then the superheat may go to zero and the state of the refrigerant leaving the evaporator will be saturated. This results in liquid refrigerant which does not provide cooling and must re-pumped by the ejector.

Additionally, compressor speed may be varied to control overall system capacity. Increasing the compressor speed will increase the flow rate to each of the two ejectors and therefore to each of the two evaporators.

Although the exemplary system has five controllable parameters (compressor speed, two controllable ejectors, and two controllable expansion devices), other situations are possible. The compressor may be fixed speed, one or both ejectors may be non-controllable, or a TXV or fixed expansion device may be used in place of one or both EXV. An alternative is to use, for example, a passive expansion device such as an orifice which (along with the separator) may be sized to allow evaporator overfeed or underfeed and self correct the evaporator exit condition. With the fixed speed compressor, capacity may be controlled by simply cycling the system on and off. Also, P1 may be controlled by controlling an additional expansion device between the heat rejection heat exchanger and the first ejector.

Figure 5:
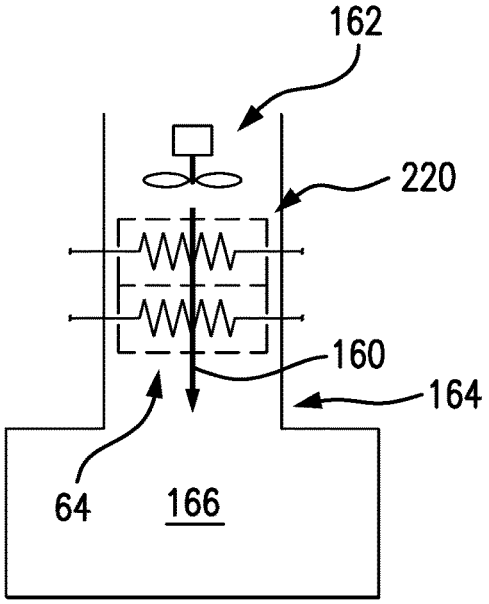
FIG. 5 is a schematic representation of a first evaporator positioning for the system of FIG. 3.

FIG. 5 shows an implementation wherein a single airflow 160 passes over both evaporators 220 and 64. In this example, the airflow passes directly between the two evaporators. One possible implementation is to form the two evaporators as separate portions of a single physical unit (e.g., a single array of tubes where the different evaporators are formed as different sections of the array by appropriate coupling of tube ends). The airflow 160 may be driven by a fan 162. One example of this is a residential air handling unit 164 for delivering air to a conditioned space 166 (e.g., building/room). In this situation, the second evaporator 220 could remove sensible heat while the first evaporator 64 essentially removes the latent heat. This may be used to provide humidity control.

Figure 6:
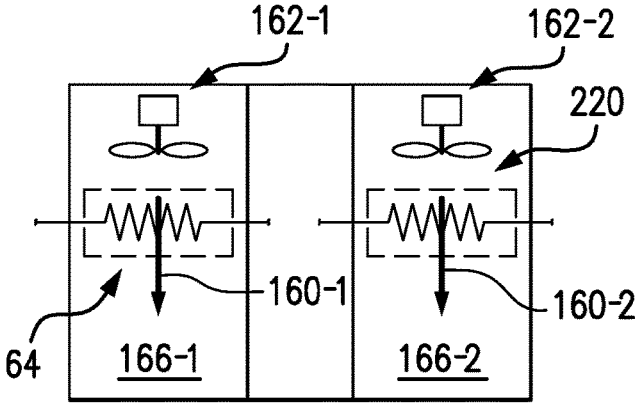
FIG. 6 is a schematic representation of a second evaporator positioning for the system of FIG. 3.

FIG. 6 shows a system wherein separate airflows 160-1 and 160-2 are driven across the evaporators 64 and 220 respectively via fans 162-1 and 162-2. Such a system may be used to differently condition different spaces. For example, a refrigerated transport or fixed-site refrigeration system, the space 166-1 could be a frozen food storage area; whereas, the space 166-2 could be a storage area for refrigerated perishables maintained at a somewhat higher temperature than the space 166-1. Alternatively, the two spaces could represent different temperature zones of a residential or commercial building.

The system may be fabricated from conventional components using conventional techniques appropriate for the particular intended uses.

Although an embodiment is described above in detail, such description is not intended for limiting the scope of the present disclosure. It will be understood that various modifications may be made without departing from the spirit and scope of the disclosure. For example, when implemented in the remanufacturing of an existing system or the reengineering of an existing system configuration, details of the existing configuration may influence or dictate details of any particular implementation. Accordingly, other embodiments are within the scope of the following claims.

What is claimed is:

1. A system (200) comprising:

a compressor (22);

a heat rejection heat exchanger (30) coupled to the compressor to receive refrigerant compressed by the compressor;

a first ejector (38) having:

a primary inlet (40) coupled to the heat rejection heat exchanger to receive refrigerant;

a secondary inlet (42); and an outlet (44);

a first separator (48) having:

an inlet (50) coupled to the outlet of the first ejector to receive refrigerant from the first ejector;

a gas outlet (54) coupled to the compressor to return refrigerant to the compressor; and a liquid outlet (52);

a first heat absorption heat exchanger (64) coupled to the liquid outlet of the first separator to receive refrigerant and coupled to the secondary inlet of the first ejector to deliver refrigerant to the first ejector, wherein the only flowpath to the first ejector secondary inlet passes through the first heat absorption heat exchanger;

a second ejector (202) having:

a primary inlet (204) coupled to the liquid outlet of the first separator to receive refrigerant;

a secondary inlet (206); and an outlet (208);

a second separator (210) having:

an inlet (212) coupled to the outlet of the second ejector to receive refrigerant from the second ejector;

a gas outlet (216) coupled to the compressor to return refrigerant to the compressor; and a liquid outlet (214); and a second heat absorption heat exchanger (220) coupled to the liquid outlet of the second separator to receive refrigerant and to the secondary inlet of the second ejector to deliver refrigerant.

2. The system of claim 1 further comprising:

a first expansion device (70) between the first separator liquid outlet (52) and the first heat absorption heat exchanger (64) inlet (66); and a second expansion device (226) between the second separator (210) liquid outlet (214) and the second heat absorption heat exchanger (220) inlet (222).

3. The system of claim 1 wherein:

the first and second separators are gravity separators.

4. The system of claim 1 wherein:

the system has no other separator.

5. The system of claim 1 wherein:

the system has no other ejector.

6. The system of claim 1 wherein:

the system has no other compressor.

7. The system of claim 1 wherein:

the gas outlet (54) of the first separator feeds an economizer port of the compressor; and the gas outlet (216) of the second separator feeds a suction port of the compressor.

8. The system of claim 1 wherein:

the first heat absorption heat exchanger is in a first refrigerated space; and the second heat absorption heat exchanger is in a second refrigerated space.

9. The system of claim 1 wherein:

the refrigerant comprises at least 50% carbon dioxide, by weight.

10. A method for operating the system of claim 1 comprising running the compressor in a first mode wherein:

the refrigerant is compressed in the compressor;

refrigerant received from the compressor by the heat rejection heat exchanger rejects heat in the heat rejection heat exchanger to produce initially cooled refrigerant;

the initially cooled refrigerant passes through the first ejector; and a liquid discharge of the first separator is split into a first portion passing to the first ejector secondary inlet (42) and a second portion passing to the primary inlet (204) of the second ejector.

11. The method of claim 10 wherein:

the first portion of the liquid discharge of the first separator passes to the first ejector secondary inlet through an expansion device (70) followed by the first heat absorption heat exchanger (64); and the second portion of the liquid discharge of the first separator passes directly to the primary inlet of the second ejector.

12. The method of claim 10 wherein:

an entire gas discharge of the first separator passes to an economizer port of the compressor; and an entire gas discharge of the second separator passes to a suction port of the compressor.

13. The method of claim 10 further comprising:

driving a first airflow across the first heat absorption heat exchanger via a first fan to cool a frozen food storage area; and driving a second airflow across the second heat absorption heat exchanger via a second fan to cool a refrigerated perishables storage area.

14. The method of claim 10 further comprising:

driving an airflow across the second heat absorption heat exchanger and therefrom across the first heat absorption heat exchanger.

15. The system of claim 1 further comprising:

a fan positioned to drive an airflow sequentially across the second heat absorption heat exchanger and therefrom across the first heat absorption heat exchanger.

16. A method for running a system (200), the system comprising:

a compressor (22);

a heat rejection heat exchanger (30) coupled to the compressor to receive refrigerant compressed by the compressor;

a first ejector (38) having:

a primary inlet (40) coupled to the heat rejection heat exchanger to receive refrigerant;

a secondary inlet (42); and an outlet (44);

a first separator (48) having:

an inlet (50) coupled to the outlet of the first ejector to receive refrigerant from the first ejector;

a gas outlet (54) coupled to the compressor to return refrigerant to the compressor; and a liquid outlet (52);

a first heat absorption heat exchanger (64) coupled to the liquid outlet of the first separator to receive refrigerant and coupled to the secondary inlet of the first ejector to deliver refrigerant to the first ejector;

a second ejector (202) having:

a primary inlet (204) coupled to the liquid outlet of the first separator to receive refrigerant;

a secondary inlet (206); and an outlet (208);

a second separator (210) having:

an inlet (212) coupled to the outlet of the second ejector to receive refrigerant from the second ejector;

a gas outlet (216) coupled to the compressor to return refrigerant to the compressor; and a liquid outlet (214); and a second heat absorption heat exchanger (220) coupled to the liquid outlet of the second separator to receive refrigerant and to the secondary inlet of the second ejector to deliver refrigerant, the method comprising running the compressor in a first mode wherein:

the refrigerant is compressed in the compressor;

refrigerant received from the compressor by the heat rejection heat exchanger rejects heat in the heat rejection heat exchanger to produce initially cooled refrigerant;

the initially cooled refrigerant passes through the first ejector;

a liquid discharge of the first separator is split into a first portion passing to the first ejector secondary inlet (42) and a second portion passing to the primary inlet (204) of the second ejector;

an entire gas discharge of the first separator passes to an economizer port of the compressor; and an entire gas discharge of the second separator passes to a suction port of the compressor.

17. The method of claim 16 wherein:

the first portion of the liquid discharge of the first separator passes to the first ejector secondary inlet through an expansion device (70) followed by the first heat absorption heat exchanger (64); and the second portion of the liquid discharge of the first separator passes directly to the primary inlet of the second ejector.

18. The method of claim 16 wherein:

the first heat absorption heat exchanger is in a first refrigerated space; and the second heat absorption heat exchanger is in a second refrigerated space.

19. The method of claim 16 wherein:

the system has no other ejector.

20. The method of claim 16 wherein:

the system has no other compressor.

* * * * *